US009079737B2

(12) United States Patent
Gelli et al.

(10) Patent No.: US 9,079,737 B2
(45) Date of Patent: Jul. 14, 2015

(54) REWINDING MACHINE AND WINDING METHOD

(75) Inventors: Mauro Gelli, Capannori (IT); Romano Maddaleni, Bientina (IT); Franco Montagnani, Palaia (IT); Roberto Morelli, S. Maria a Colle (IT)

(73) Assignee: FABIO PERINI S.P.A., Lucca (IT)

( * ) Notice: Subject to any disclaimer, the term of this patent is extended or adjusted under 35 U.S.C. 154(b) by 242 days.

(21) Appl. No.: 13/261,408

(22) PCT Filed: Feb. 14, 2011

(86) PCT No.: PCT/IT2011/000037

§ 371 (c)(1),
(2), (4) Date: Oct. 3, 2012

(87) PCT Pub. No.: WO2011/104737

PCT Pub. Date: Sep. 1, 2011

(65) Prior Publication Data

US 2013/0020427 A1 Jan. 24, 2013

(30) Foreign Application Priority Data

Feb. 23, 2010 (IT) ..... FI2010A0025

(51) Int. Cl.
*B65H 35/08* (2006.01)
*B65H 19/26* (2006.01)
*B65H 19/22* (2006.01)

(52) U.S. Cl.
CPC ..... *B65H 19/267* (2013.01); *B65H 19/2269* (2013.01); *B65H 2513/10* (2013.01)

(58) Field of Classification Search
CPC ..... B65H 19/2269; B65H 2408/235; B65H 2301/41894
USPC ..... 242/526, 527, 527.2–527.3, 242/532.2–532.3, 542
See application file for complete search history.

(56) References Cited

U.S. PATENT DOCUMENTS

| | | | | |
|---|---|---|---|---|
| 5,979,818 | A | 11/1999 | Perini et al. | |
| 6,056,229 | A | 5/2000 | Blume et al. | |
| 6,948,677 | B2 * | 9/2005 | Biagiotti et al. | 242/521 |
| 7,175,127 | B2 | 2/2007 | Butterworth et al. | |
| 7,318,562 | B2 * | 1/2008 | Biagiotti et al. | 242/521 |
| 8,181,897 | B2 * | 5/2012 | Tsai | 242/521 |
| 8,220,736 | B2 * | 7/2012 | Tsai | 242/532.2 |
| 2003/0037725 | A1 | 2/2003 | Daul et al. | |
| 2004/0061021 | A1 | 4/2004 | Butterworth | |
| 2009/0026299 | A1 * | 1/2009 | Tsai | 242/160.4 |
| 2010/0294875 | A1 * | 11/2010 | Tsai | 242/521 |

FOREIGN PATENT DOCUMENTS

| | | | |
|---|---|---|---|
| EP | 1 205 414 | A2 | 5/2002 |
| EP | 1 262 434 | A2 | 12/2002 |
| WO | WO 2006/025842 | A2 | 3/2006 |

* cited by examiner

*Primary Examiner* — Sang Kim
(74) *Attorney, Agent, or Firm* — Breiner & Breiner, L.L.C.

(57) ABSTRACT

The rewinding machine includes a first winding roller, around which the web material is guided, and defining at least in part a winding cradle; a support surface of the winding cores arranged to receive a winding core and to convey the core toward the winding cradle, the support surface defining with the first winding roller a feed channel of winding cores, a severing member of the web material, which can be inserted in the channel to sever the web material, the severing member interacting with the web material to cause severing thereof; a motor for controlling the severing member, the motor controlling the severing member modifying the speed of the severing member when it is positioned inside the channel.

37 Claims, 7 Drawing Sheets

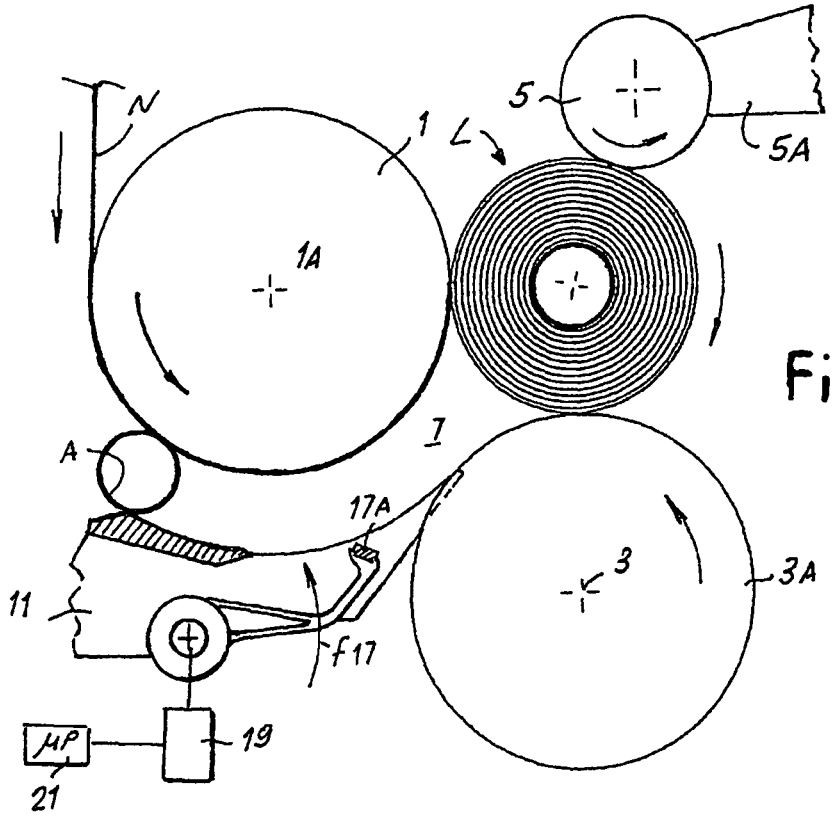
Fig. 4A
Fig. 4B
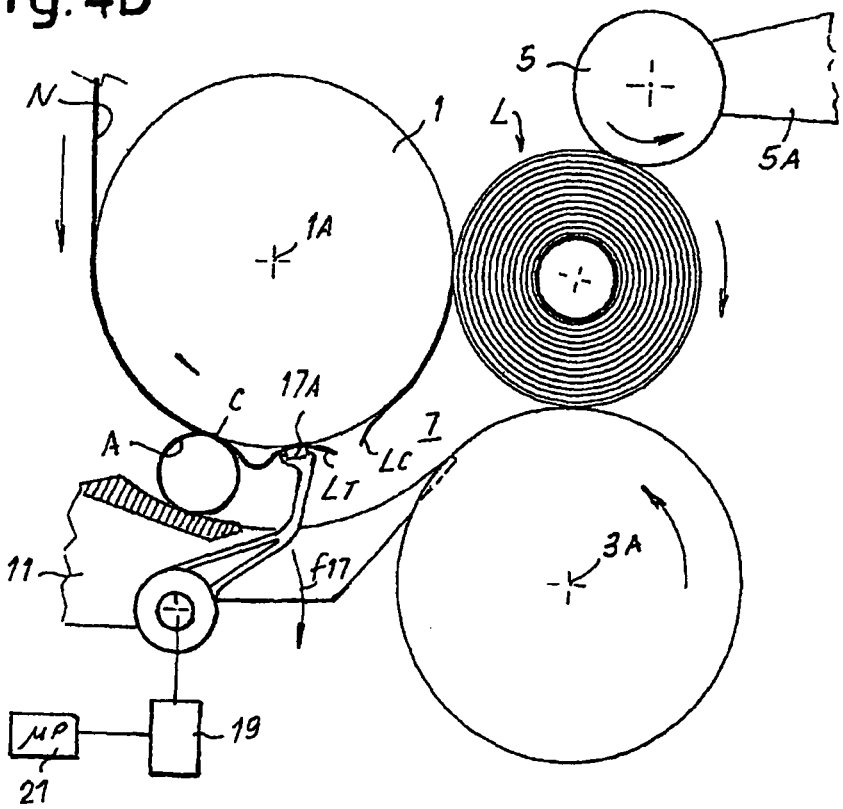

REWINDING MACHINE AND WINDING METHOD

TECHNICAL FIELD

The present invention relates to a rewinding machine for producing logs of web material wound around tubular winding cores.

The invention also relates to a new winding method for producing logs of web material around tubular winding cores.

STATE OF THE ART

In the production of logs of wound web material, such as rolls of toilet paper, kitchen towel or the like, reels of large diameter, called parent reels, are initially formed, from which the web material is then unwound and rewound on logs of smaller diametric dimensions, corresponding to the dimensions of the end product destined for sale, and of axial length equal to a multiple of the axial dimension of the rolls destined for final use. These logs are subsequently cut to form the rolls destined for use, which are packaged.

Rewinding machines, in particular for the field of tissue paper converting, for manufacturing rolls of toilet paper, kitchen towels and similar products, are completely automatic high speed machines that can process one or more plies of cellulose fiber fed at high speeds, even equal to or greater than 1000 m/min. Modern rewinding machines therefore form logs of wound material with high rates, up to one log every 1-2 seconds or less.

After a log has been wound a series of operations must be carried out, which are defined as a whole as "exchange phase". In the exchange phase operations are performed to sever the web material, unload the finished log, fasten the leading edge of the web material (obtained by severing the web material) to the new winding core that is inserted in the machine and start winding of the new log.

These operations must be carried out at very fast frequency to avoid slowing the production cycle, as the average speed of the web material is not modified during the exchange phase. Vice versa, there is only a possible local variation of the speed of the web material in the area in which this is to be severed.

U.S. Pat. No. 5,979,818 describes a new generation rewinding machine, wherein the web material is wound in a winding cradle preferably formed by a group of three winding rollers. The web material is guided around a first winding roller and passes through a winding nip defined between the first winding roller and a second winding roller. Positioned upstream of this nip is a support surface of the winding cores that are inserted in an inlet of a channel defined between said support surface and the first winding roller. In some embodiments described in this prior art document, positioned along the channel is a web material severing member, preferably designed and arranged in such a manner as to sever the web material by pinching it against the first winding roller and causing local slowing of the web material between the pinch point and the log being wound in the winding cradle. This slowing causes tension of the web material and finally severing thereof, preferably along a perforation line produced by a perforator positioned upstream of the winding cradle.

Machines based on this principle are extremely flexible, reliable and capable of producing logs with high axial lengths at very high speeds, equal to or even greater than 1000 m/min.

The product manufactured with these machines is susceptible to further improvements, as the web material wound on each winding core has, in the innermost turn, a fold-back that constitutes, due to its length, a slight defect at least for certain types of product. The length of this fold-back depends on the point in which the web material is severed. This point is positioned at a certain distance from the contact point of the web material with the new winding core. The portion of web material between the point of fastening to the new winding core and the point of severing is folded to form a fold-back of a length corresponding to the distance between these two points.

Moreover, the severing member is provided with pressure pads with which it presses the web material against the winding roller. The pressure exerted by the pads causes rapid wearing of the pads which consequently need to be adjusted, as otherwise at a certain point the pads would no longer press sufficiently against the winding roller and would no longer cause severing of the web material. Typically, this adjustment must be carried out about once every two weeks and, as this is a mechanical adjustment, requires a manual operation.

In some embodiments of current rewinding machines designed on the basis of the teaching of the aforesaid patent, the pressure exerted by the severing member on the winding roller is high and causes the whole of the rewinding machine to vibrate. Besides representing a structural problem, which causes wear of the mechanical parts and noise, this can have negative effects on the correct operation of the machine, as tearing of the web material may not take place in the desired point, which is identified by a precise perforation line of the web material.

US-A-2004/0061021, U.S. Pat. Nos. 6,877,689 and 7,175,127 disclose rewinding machines wherein the web material severing member is controlled in such a manner as to cause tearing of the web material between the two points of the web material defined by the area of contact with the severing member and the area of contact with the new core inserted in the winding channel. Operating in this manner a shorter fold-back is obtained. However, the machine looses a great part of its reliability, as a resuit of decreased control of the web material in the exchange phase and it is more difficult to achieve high production speeds.

SUMMARY OF THE INVENTION

According to one aspect, the object of the invention is to produce a rewinding machine that overcomes, completely or in part, at least one of the drawbacks of prior art rewinding machines. The object of some embodiments of the invention is to provide a more efficient rewinding machine, and in particular a rewinding machine with which a product of better quality is obtained even at high production rates and without loss of the advantages typical of the most modern and reliable rewinding machines known in the art.

The object of some embodiments of the invention is to provide a rewinding machine wherein the frequency of operations to adjust the severing member of the web material is reduced and/or wherein adjustment can take place more efficiently, without requiring long machine stops and mechanical operations on machine members.

The object of yet other embodiments of the invention is to provide a rewinding machine wherein the vibrations caused by operation of the web material severing member are reduced.

Substantially, in one embodiment the invention provides a rewinding machine for winding a web material around a tubular core, comprising: a first winding roller, around which said web material is guided, at least partly defining a winding cradle; preferably a second winding roller, defining with the first winding roller a nip through which the web material is fed; a winding cores support surface, arranged to receive a winding core and to convey it toward the winding cradle and defining with the first winding roller a feed channel for the winding cores, in which channel the cores are fed in contact with the support surface and with the web material guided around said first winding roller; a winding core inserter for inserting winding cores in the channel; a web material severing member, which can be inserted in the channel to sever the web material, said severing member interacting with the first winding roller and with the web material guided around said first winding roller to cause severing thereof; preferably a motor for controlling said severing member, which controls the severing member modifying the speed of the severing member when it is positioned inside said channel. Specifically, the severing member is accelerated after severing of the web material has taken place. Such acceleration avoids collision between the severing member and the new core advancing along said channel even though severing of the web material is performed by keeping the severing member quite near to the new core. This reduces the length of the leading portion of the web material which folds back upon start of winding around the new core.

Speed variation must be intended in general as an acceleration without reversal of movement or with reversal of movement. I.e. acceleration can be understood as an acceleration of the severing member without reversal of the advancement movement thereof, or else as a reversal of the direction of motion. In preferred embodiments the acceleration of the severing member is caused by a motor under the control of a suitably programmed electronic control unit.

By varying the speed of the severing member while it is positioned in the cores feed channel it is possible to make the severing member interact with the web material at an optimal speed to cause severing of the web material and subsequently modify the speed of the severing member (with or without reversal of speed and therefore of the direction of movement) to avoid collision with the core being fed along the channel. In this manner, it is possible to move the severing point of the web material closer to the winding core that is inserted in the channel, thus reducing the length of the tail edge of web material that is wound on the new winding core, producing a log of better quality, without having to reduce the production speed, determined by the feed speed of the web material.

In some preferred embodiments of the invention, the motor that operates the severing member can be designed and controlled in such a manner as to control the severing member such as to insert and advance the severing member in the channel with a direction of feed opposite with respect to the direction of feed of the cores along the channel. In this case, during the web material severing step the severing member is moved toward a core insertion end of said channel and therefore toward a core inserted therein. Subsequently, reversing the movement of the severing member, it is moved away from the insertion end of the channel. In substance, the severing member is inserted in the core feed channel in a position downstream of the winding core and close to the winding cradle. Subsequently, movement of the severing member continues toward the inlet of the channel, i.e. in the opposite direction with respect to the direction of feed of the cores and of the web material in the channel. This ensures that, by interacting with the web material, for example pinching it against the winding roller, the severing member causes severing of the web material between the position of contact with the web material and the log being wound in the winding cradle. Subsequently, by reversing the movement thereof, the severing member is withdrawn from the channel, exiting substantially in the same area in which it was inserted in the channel.

In the second step of its movement, the severing member therefore moves in a direction substantially concordant with the direction of feed of the winding core, avoiding collision therewith.

In other words, in this embodiment the severing member is controlled according to a reciprocating movement, preferably a rotary reciprocating movement, traveling along a same trajectory in one direction and then in the opposite direction, the severing member interacting with the web material and causing severing thereof in the point of reversal of its trajectory.

With a configuration of this type it is possible both to reduce the length of the tail of web material that is folded back after severing of the web material and to reduce the vibrations caused in the rewinding machine as a result of the action of the severing member against the winding roller. Moreover, it is also possible to adjust the severing member to compensate for wear without the need to stop the machine and to act manually on the mechanical members. In fact, in this case it is possible to carry out the adjustments from a control panel, modifying the movement of the motor that causes operation of the severing member. When the pads of the severing member become worn, it is sufficient to extend the trajectory of the severing member moving the point in which movement is reversed closer to the inlet of the channel, thus always obtaining adequate pressure of the severing member against the winding roller, sufficient to obtain tearing of the web material. For example, it could be sufficient to increase the angle of rotation of the web material severing member by a hundredth of a degree each week in the opposite direction with respect to the direction of feed of the winding cores.

Besides the possibility of performing this adjustment through an interface from the control panel without the need to act manually on mechanical members, in this embodiment of the invention there is substantially less wear with respect to conventional machines, provided with a severing member that rotates without reversing the rotational movement during the whole of the exchange cycle. This is due to the fact that it is possible to maintain the necessary pressure between pad and web material at a constant minimum value, still sufficient to cause tearing. According to a particularly advantageous embodiment of the invention, it is possible to adjust this pressure between pad and web material as a function of the resistance of the portions of web material between the perforations defining a perforation line. In this manner, tearing is caused as a function of the type of product. Alternatively, or additionally, it is possible to adjust the pressure between pad and web material as a function of the speed of the web material. In fact, when the speed increases a lower pressure of the pad against the web material is necessary to cause tearing thereof.

Due to the lower pressure between pad and paper (and therefore lesser thrust of the pad against the roller) a reduction of the vibrations is also obtained and consequently the mechanical stress caused by this effect is reduced or eliminated, as is the risk of severing of the web material imprecisely and not coincident with the perforation line along which the machine must tear the web material.

In other embodiments, the severing member is controlled to move inside the cores feed channel without reversing the advancement speed thereof, but in such a manner as to be accelerated after having interacted with the web material causing severing thereof. In substance, the severing member is made to advance along the channel at a lower speed with respect to the feed speed of the web material, to cause severing of the web material as a result of slowing thereof caused by interaction with the severing member. Subsequently, the speed of the severing member is increased so as to prevent collision with the core that is being fed in the channel. In practice, in some embodiments the severing member advances in the cores feed channel at variable speed: a first lower speed to interact with the web material and cause tearing thereof downstream of the point of interaction with the severing member; and a second higher speed to withdraw the severing member from the channel before collision with the winding core. The severing point of the web material is in this manner brought closer to the point of contact between the winding core and the web material guided around the winding roller, thus reducing the length of the tail of web material that is folded back when the first turn is formed around the winding core.

In some embodiments the severing member is provided with a rotational movement around an axis outside said channel. In other embodiments, the severing member can be provided with a linear movement.

In some embodiments the severing member is controlled to interact with said web material and cause severing thereof moving at a speed no greater than 70% and preferably no greater than 50% of the speed of the web material. When the severing member is provided with a rotational movement, speed of the severing member is intended as the peripheral speed that the member assumes in the point of contact with the web material, as it is this speed that determines the conditions of interaction with the web material and therefore the action to obtain tearing or severing of the web material.

In some embodiments the feed movement of the winding core in the channel is controlled, for example by providing a rotating member arranged in a position along said channel, opposite said first winding roller and at a distance therefrom such as to allow the passage of a winding core between the first winding roller and the rotating member. The rotating member is positioned, with respect to the direction of feed of the core in said channel, upstream of the area of interaction between the severing member and the web material; the rotating member being controlled by an actuator to control the feed movement of the core along said channel.

According to a different aspect, the invention provides a method for winding a web material around a winding core in a rewinding machine, comprising the steps of:

- feeding said web material at a feed speed around a first winding roller defining at least in part a winding cradle;
- inserting a winding core adjacent to said first winding roller in a channel between said first winding roller and a support surface of the winding cores, advantageously in contact with the support surface and with the web material guided around the first winding roller;
- providing a severing member, advantageously controlled by a motor;
- by means of said motor, inserting the severing member in said channel and acting with said severing member on said web material along said channel, for example pinching the web material between the severing member and the first winding roller, moving said severing member into contact with said web material at a speed lower than the feed speed of the web material, causing severing of the web material between a log in said winding cradle and said severing member;
- after severing of the web material, accelerating said severing member and making it exit from said channel.

According to some preferred embodiments of the method according to the invention, the severing member is inserted in the channel with a movement in a direction opposite the direction of feed of the web material in said channel, is pressed against the web material, causing severing thereof in a position between the severing member and a log being formed in the winding cradle and subsequently the movement of the severing member is reversed to remove it from the channel.

Further advantageous features and embodiments of the invention are set forth in the appended claims, which form an integral part of the present description.

BRIEF DESCRIPTION OF THE DRAWINGS

The invention will be better understood by following the description and accompanying drawing, which shows practical non-limiting embodiments of the invention. More in particular:

FIGS. 4A-4C show a sequence similar to the sequence of FIGS. 2A-2C with a different configuration of the severing member.

DETAILED DESCRIPTION OF THE INVENTION

Figure 1A:
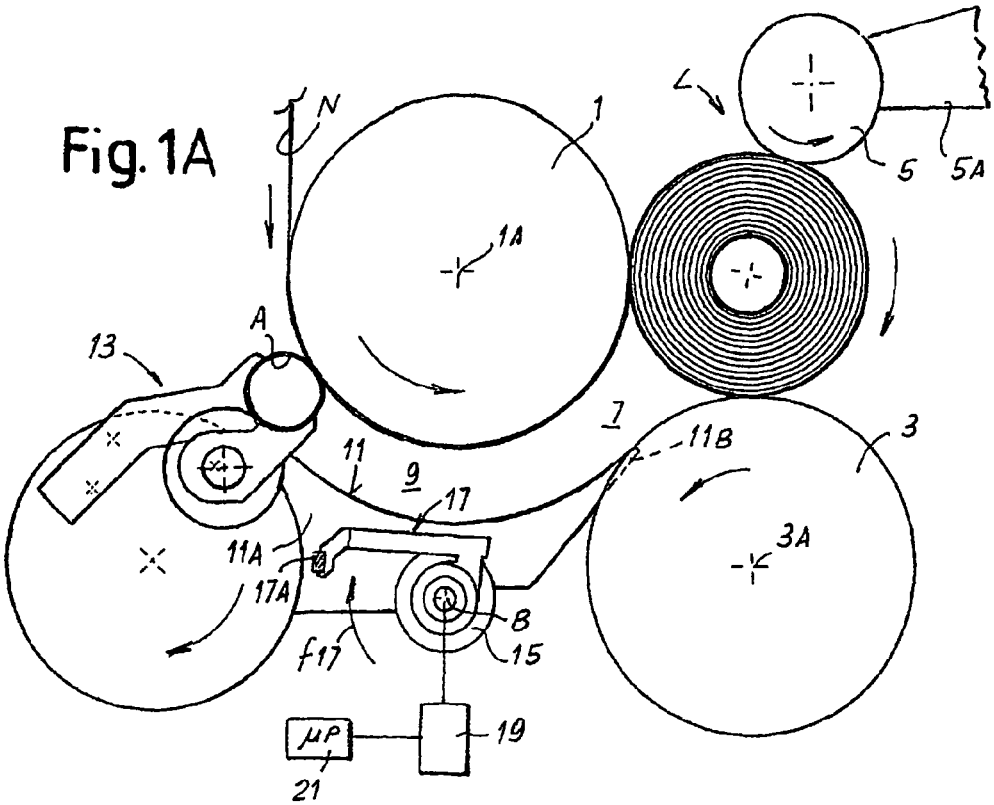
FIGS. 1A to 1C show an operating sequence in the exchange phase of a rewinding machine in a first embodiment of the invention.
Figure 1B:
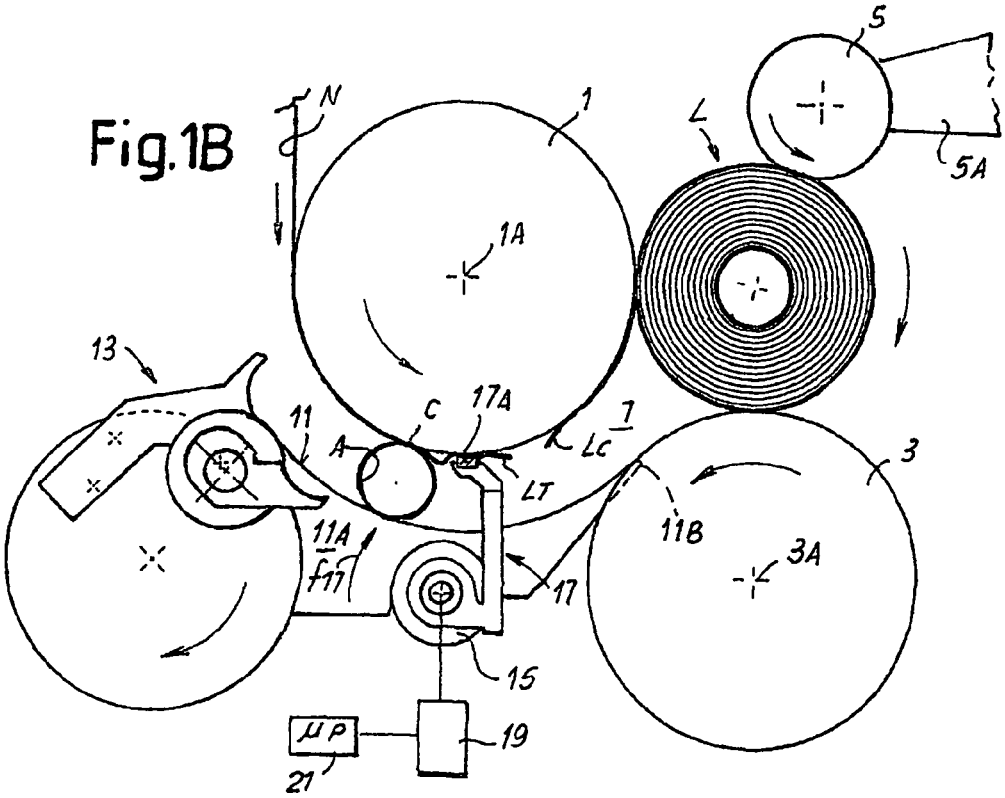
Figure 1C:
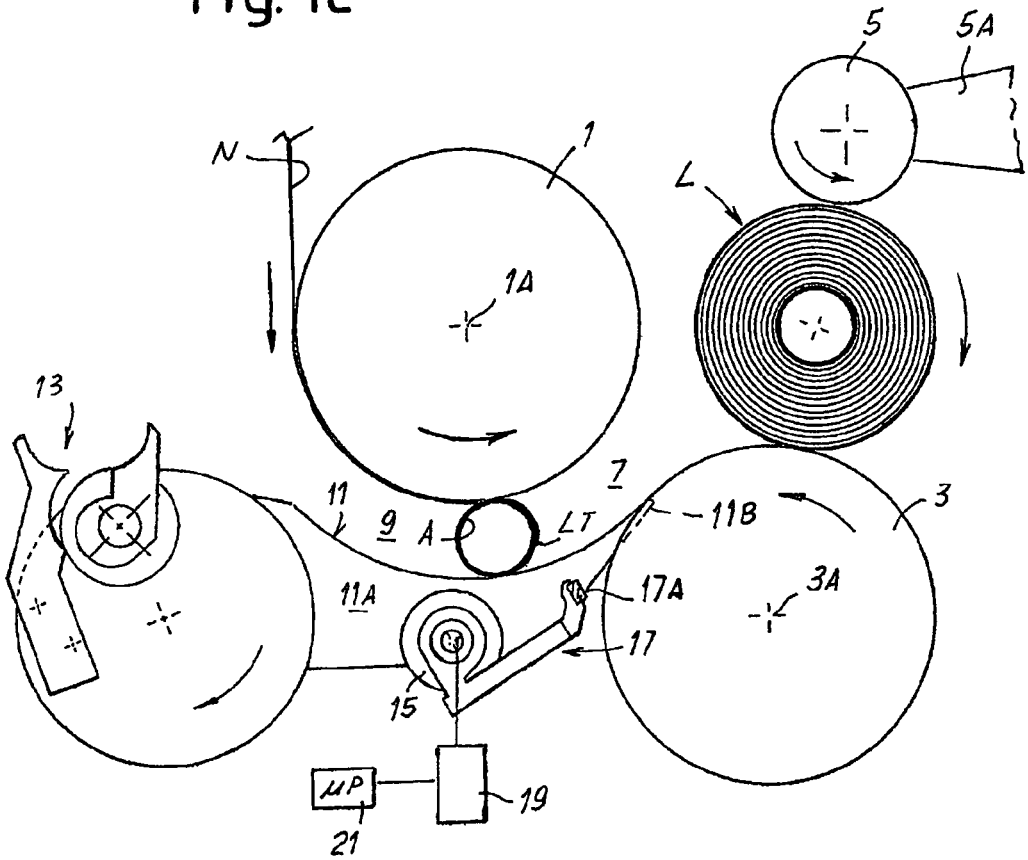

With initial reference to FIGS. 1A to 1C, in a possible embodiment the rewinding machine comprises a first winding roller 1, a second winding roller 3 and a third winding roller 5. The first and the second winding roller 1, 3 form therebetween a winding nip 7, through which the web material N is fed to be wound to form logs L in a winding cradle defined by the group of three rollers 1, 3, 5. The third winding roller is supported by arms 5A so that it can be gradually raised and allow increase of the diameter of the log L being formed in the winding cradle 1, 3, 5. Operation of peripheral rewinding machines based on the use of winding rollers of the type described above is known in the art and does not require to be described in detail herein.

Upstream of the nip 7 between the winding rollers 1 and 3 (with respect to the direction of feed of the web material N) a channel 9 extends, formed between the cylindrical surface of the first winding roller 1 and a support surface 11 of the winding cores A which are inserted in sequence in the machine. Insertion of the cores A inside the channel 9 is obtained with a core inserter 13, which picks up the cores from a feed conveyor, not shown, along which a glue applicator can also be provided to apply a glue according to annular or longitudinal lines on the winding cores A to allow adhesion of the web material N at the start of winding of each log L. The inserter 13 represented in the figures is indicated purely by way of example, it being understood that the cores can be fed to the machine with any inserter of suitable shape.

Positioned below the support surface 11 of the cores A is a support unit 15 for a severing member indicated as a whole with 17. The severing member 17 rotates around an axis B, placed below the support surface 11 of the winding cores A and therefore outside the feed channel 9 of the winding cores into the rewinding machine. In its general lines the severing member 17 is similar to the one described for exampie in U.S. Pat. No. 5,979,818, whose content is incorporated in the present description. However, as will be apparent hereunder, the method with which it is controlled is different with respect to that provided in prior art machines, in order to solve the aforesaid problems.

The severing member 17 is provided with an end 17A for example constituted by or bearing one or more pads made of material with high friction coefficient, such as rubber or the like, and preferably elastically yielding. These pads 17A interact with the web material N guided around the winding roller 1 to cause pinching thereof and severing as a result of slowing of the web material N with respect to the winding speed defined by the peripheral speed of the winding roller 1.

The rotational movement of the severing member 17 around the axis B is controlled by a motor, indicated schematically with 19. The motor 19 is only schematically represented in the figures. It can be replaced, for example, by a motor arranged coaxially with respect to the rotation axis B of the severing member 17, to which it transmits motion directly. In other embodiments, a gear, a transmission or a combination thereof can be arranged between the motor 19 and the rotation shaft of the severing member 17.

The motor 19 is controlled by an electronic programmable control unit 21 indicated schematically in FIG. 1A. The control unit 21 can also be connected to other members, such as actuators, motors, sensors, encoders and other elements, components, instruments, units or parts of the rewinding machine, in a known manner. For example, the control unit 21 can be connected to the motors that control rotation of the winding rollers 1, 3, 5, to the actuator that controls the core inserter 13, to the perforator (not shown), to the actuator that controls movement of the axis of the winding roller 5 away from and toward the axes of the winding rollers 1 and 3, and to other members of the machine. In general, the control unit 21 is able to recognize the position of the winding core A during insertion into the machine, to control, in a synchronized manner, the members that perform the exchange phase, i.e. the phase in which: a completed log L is unloaded from the winding cradle 1, 3, 5 while a new winding core A is inserted in the machine; the web material is severed, cut or torn to form the trailing edge of the log L and the leading edge of a new log that must be wound around the new winding core; the leading edge is fastened to the new core and the web material starts to wind around it. The control unit 21 can for this purpose be provided with signal inputs coming from encoders associated with one or more members of the machine and/or by sensors to detect the position of the core along its feed path.

With reference to the sequence of FIGS. 1A, 1B, 1C, the exchange phase or cycle, i.e. severing of the web material, adhesion of the free edge formed by severing of the material to a new winding core and start of formation of a new log, as well as unloading of the log completed in the winding cycle that has just finished, will be described below.

FIG. 1A shows the final instant of the winding step of the log L positioned in the winding cradle defined by the winding rollers 1, 3, 5. A new winding core A has been taken by the inserter 13 to the inlet of the channel 9, between the end thereof opposite the nip defined between the rollers 1, 3. The winding core A can be held in this position by the inserter 13, which is controlled in synchronism with the remaining operations performed by the various members of the rewinding machine, in particular by the severing member 17 and by the winding rollers 1, 3, 5.

The severing member 17 is currently rotating in clockwise direction (in FIG. 1A) according to the arrow f17. It is still outside the feed channel 9 of the cores but is about to enter it. For this purpose, in a known manner, the support surface 11 of the cores A is formed by a comb structure constituted by a series of mutually parallel plates 11A, each of which defines a line lying on the support surface 11 of the cores. As can be seen in the figure, an end 11B of the comb structure extends inside annular channels of the lower winding roller 3, thereby forming a continuous rolling surface for advancing the cores A from the entry end into the channel 9 to the nip 7 and from the latter into the winding cradle formed by the rollers 1, 3 and 5.

In the step shown in FIG. 1B, the new winding core A has already been inserted in the feed channel 9 and is advancing along it by rolling. The channel 9 has a cross dimension (i.e. measured according to a radial direction with respect to the axis of the winding roller 1) equal to or slightly less than the diameter of the core A. This dimension can be constant or slightly increasing along the extension of the feed channel 9. In this manner the winding core A inserted in the feed channel 9 is in contact on one side with the support surface 11 and on the opposite side with the web material N guided around the winding roller 1. The slight interference of the core A with the winding roller 1 on one side and with the support surface 11 on the other causes sufficient pressure to be generated in the opposite points of contact with the web material N and with the support surface 11 to make the core A advance by rolling along the channel 9 as shown in FIG. 1B. The feed speed of the core, i.e. the speed of the center point thereof along the channel 9 is equal to half of the vector sum of the speeds of the points of contact with the web material N and with the support surface 11 respectively.

The severing member 17 in the meantime has fully entered the cores feed channel 9 and has advanced until it presses or pinches the web material N against the cylindrical surface of the winding roller 1.

For this purpose the radial dimension of the severing member 17 is such as to cause sufficient interference between the end pads 17A of the severing member 17 and the winding roller 1. The web material N is thus pinched by the severing member 17, and more precisely by the pads 17A thereof, against the opposite surface of the winding roller 1. In some embodiments, the severing member 17 has a plurality of pads 17A mutually spaced apart and aligned along the transverse direction, i.e. the direction orthogonal to the plane of the figures and therefore parallel to the axes 1A, 3A of the winding rollers 1, 3. According to some embodiments the winding roller 1 preferably has a surface structure characterized by substantially smooth annular bands, corresponding to the position of the pads 17A, and annular bands with high friction coefficient, for example coated with a grip, interposed between the annular bands with low friction coefficient. This causes slipping of the web material pinched by the pads 17A against the smooth annular bands of the cylindrical surface of the winding roller 1, as the speed of the severing member 17, i.e. the peripheral speed of the pads 17A in the contact point with the web material N, is lower than the peripheral speed of the winding roller 1, i.e. the winding speed of the web material N on the log L. In this manner excess tension of the web material N is generated between the log L completing its winding in the winding cradle 1, 3, 5 and the point in which the web material N is pinched against the winding roller 1 by the pads 17A of the severing member 17A. This tension exceeds the tearing point of the web material N causing severing of this material and therefore the formation of a trailing edge LC and of a leading edge LT (FIG. 1B) in an intermediate area between the point in which the web material is pinched by the pads 17A of the severing member 17 and the log L positioned in the winding cradle 1, 3, 5.

This tearing is achieved by suitably controlling the peripheral speed of the pads 17A, i.e. the speed of the severing member 17. This speed can, for example, be equal to 30% of the feed speed of the web material N around the winding roller 1.

Once the web material N has been severed, the motor 19 causes an acceleration of the severing member 17, which is thus moved away from the core A which is advancing by rolling along the channel 9. The instant in which acceleration of the severing member 17 starts can be determined by detecting effective severing of the web material, for example with an optical system or a system detecting the tension of the web material. In other embodiments, after experimentally determining the time required to achieve tearing of the web material, also as a function of the difference between peripheral speed of the winding rollers and peripheral speed of the severing member 17, it is possible to set the instant of angular acceleration, for example as a function of the angular position assumed by the severing member in the exchange phase.

By controlling the severing member 17 at a variable speed along the channel 9 during the exchange cycle the important advantage is achieved of moving the severing point of the web material N (i.e. the point in which the leading edge LT and the trailing edge LC are formed) toward the point in which the core A inserted in the feed channel 9 of the cores is in contact with the web material N guided around the winding roller 1. As a consequence, the portion of web material N that will be folded back inside the first turn of web material formed around the winding core A will be much smaller than that of conventional machines, while maintaining the important advantage of performing severing of the web material downstream instead of upstream of the severing member 17, with reference to the direction of feed of the web material N around the winding roller 1.

FIG. 1C shows the subsequent step in which the severing member 17 has been withdrawn from the feed channel 9 of the winding cores, while the winding core A inserted in the channel continues to roll along the channel 9 and the web material N starts to wind around it forming a short folded-back web material edge. At this point the severing member 17 can stop until the start of a new exchange phase. Advantageously, gluing of the web material N to the tubular core A takes place as a result of a line of glue C (see in particular FIG. 1B) which is applied to the core A in a given angular position in such a manner as to be positioned in the point in which the core A is pinched against the web material N when the web material N is severed by the severing member 17, FIG. 1B.

In the description above, the severing member 17 is controlled by the motor 19 under the control of the programmable control unit 21 in such a manner as to advance with a rotating movement always in the same direction (arrow f17) but at variable speed during the exchange phase: in a first time interval the severing member 17 is rotated at low speed to obtain reliable tearing of the web material as a result of the tension caused inside said material; in a second time interval the severing member 17 is accelerated to avoid collision with the winding core A.

This allows the severing point of the web material N to be moved closer to the point in which the latter is pinched by the winding core A and therefore, ultimately, reduction of the length of web material folded back inside the first turn of the new log that will be formed around the winding core A. This is due to the fact that collision with the winding core A is avoided as a result of to acceleration of the severing member 17 after the web material has been severed. This acceleration prevents collision with the winding core A even if the severing member 17 acts in proximity of the winding core A, to reduce the length of the fold-back of web material in the first turn of the log L, and at low speed, to ensure rapid severing of the web material also in the case of particularly elastic material.

Figure 2A:
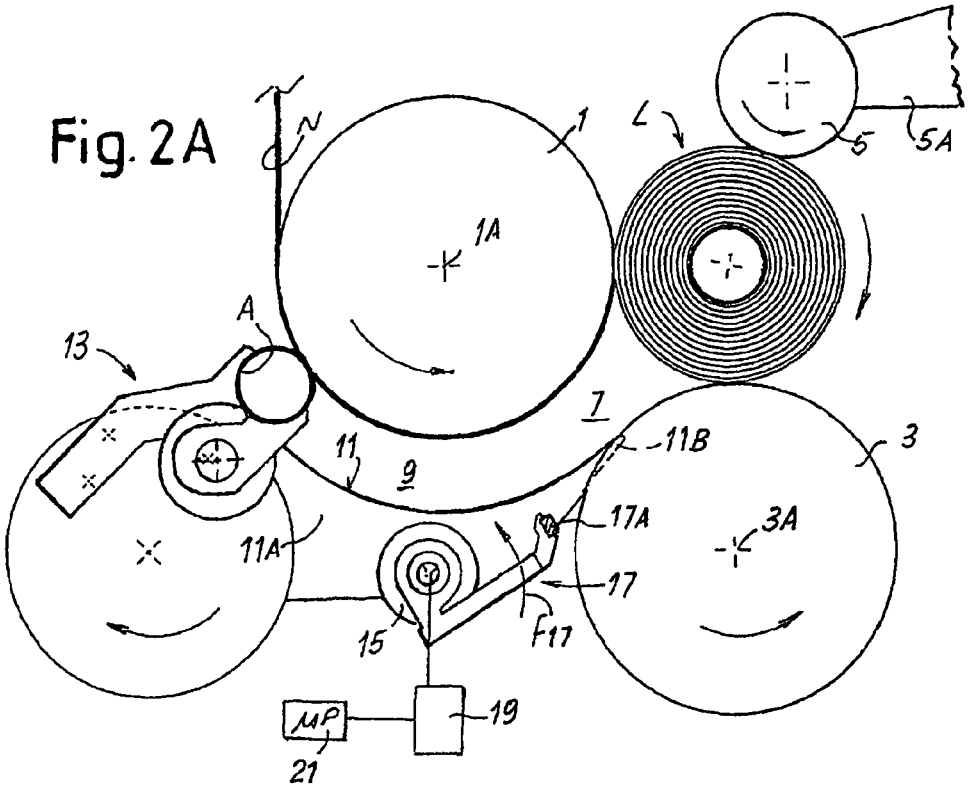
FIGS. 2A to 2C show a similar operating sequence of a rewinding machine according to the invention in a second embodiment.
Figure 2B:
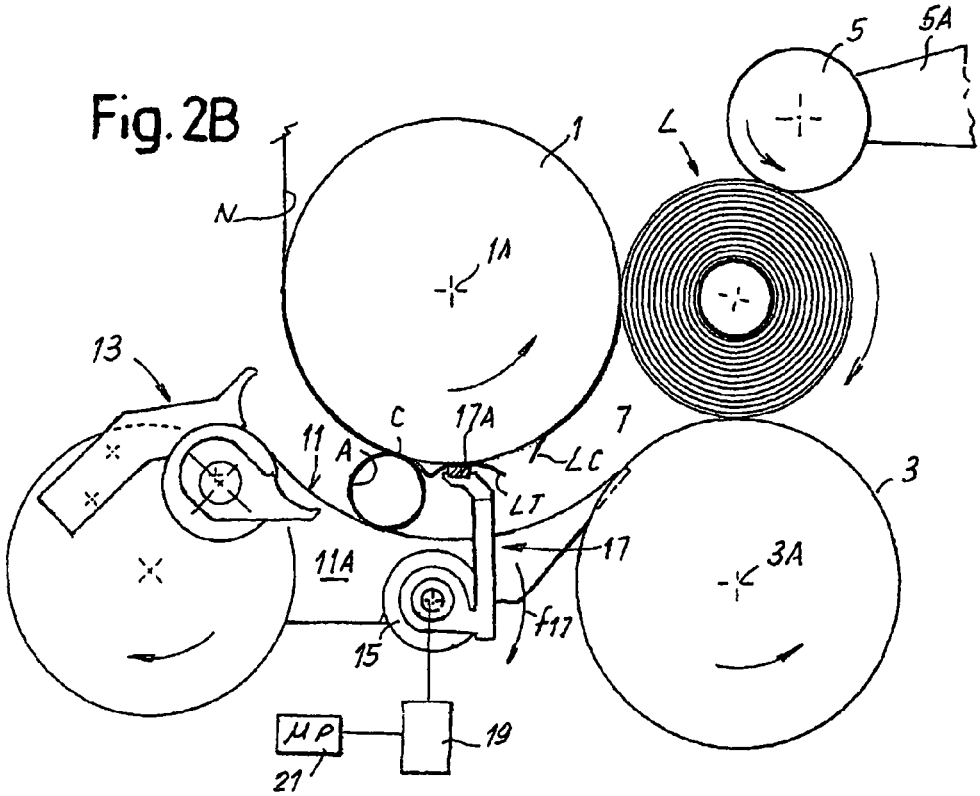
Figure 2C:
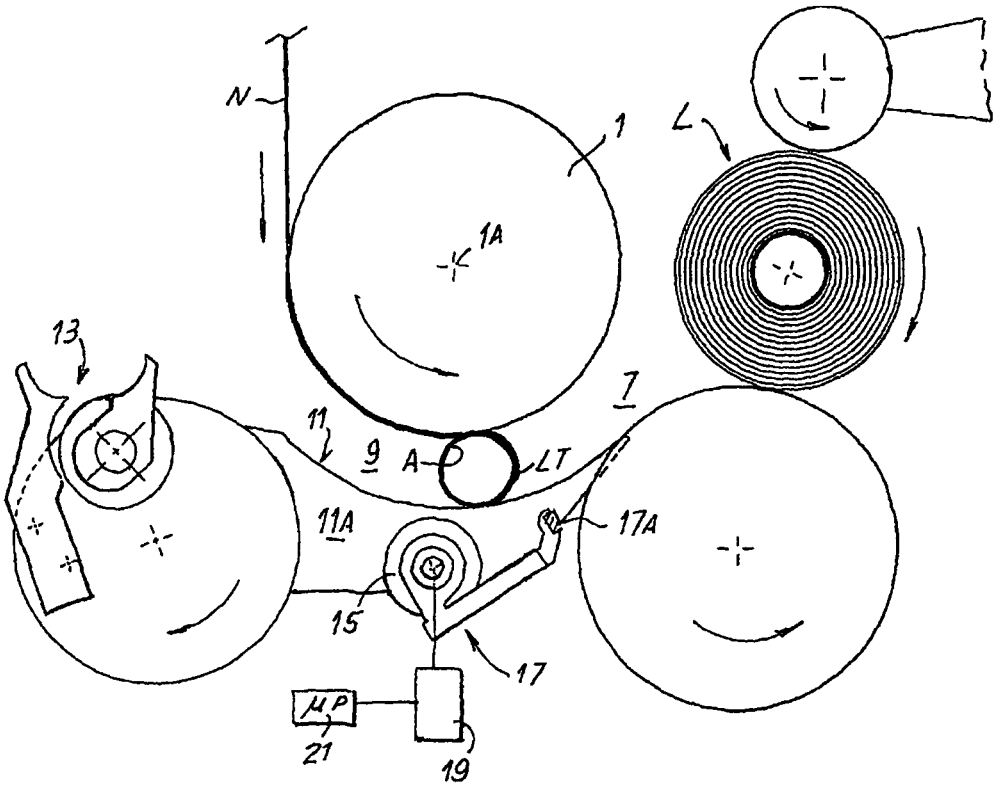

FIGS. 2A, 2B and 2C show an operating sequence in the exchange phase of a rewinding machine in a different and preferred embodiment. The same numbers indicate the same or equivalent parts to those in FIGS. 1A, 1B, 1C. The structure of the rewinding machine is substantially the same, but the manner in which the severing member 17 is controlled is different, as will be apparent from the description below of the exchange phase represented in the sequence of FIGS. 2A, 2B, 2C.

In short, in this embodiment the severing member 17 is controlled by the motor 19 under the control of the control unit 21 in such a manner as to reverse its rotational movement around the axis B. In a first time interval the severing member 17 rotates counter-clockwise (in the figure) moving toward the end of the feed channel 9 of the cores, to perform severing of the web material, while in a second time interval it rotates in the opposite direction, i.e. clockwise (in the figure) to be withdrawn from inside the feed channel 9 of the winding cores and therefore avoid collision with the new winding core fed into the channel 9.

More in particular, FIG. 2A shows a position during the exchange phase: the inserter member 13 carries a new winding core A to the inlet of the channel 9 opposite the nip 7 defined between the winding rollers 1 and 3. The log L inside the winding cradle formed by the rollers 1, 3, 5 has practically been completed and must be unloaded from the winding cradle after severing of the web material.

In FIG. 2B the severing member 17 is located inside the feed channel 9 of the cores, the winding core A has started to advance along the channel by rolling on the support surface 11 and the web material N has been severed forming the trailing edge LC and the leading edge LT. Also in this case severing takes place as a result of the difference in speed between the winding roller 1, and therefore the web material N that was being wound around the log L, and the peripheral speed of the pads 17A of the severing member 17. Also in this case the pads 17A have a lower speed and also opposite direction, with respect to the feed speed of the web material N along the channel 9.

Upstream of the severing member 17 the web material N is slackened and starts to adhere to the new winding core A.

At this point the severing member 17 can reverse its movement and be withdrawn from the feed channel 9, as can be seen in FIG. 2C. In this manner, the feed channel 9 of the cores is left free. The winding core A can roll toward the nip 7 and inside the winding cradle 1, 3, 5 without colliding with the severing member 17.

The severing member 17 remains in this position until the subsequent exchange cycle.

As observed previously with reference to the sequence of FIGS. 1A-1C, reversal of the movement of the severing member 17 (as in the previous case acceleration of the severing member 17 in the channel 9) can take place as a function of detecting effective severing of the web material. Preferably, however, the control unit 21 is programmed in such a manner as to reverse the rotational movement of the severing member 17 after having reached an angular position which, experimentally determined, is such as to guarantee severing of the web material. After reaching this position the movement is reversed.

In practice, in this embodiment the severing member 17 is therefore provided with a reciprocating movement, preferably but not necessarily a rotating reciprocating movement with reversal of direction when the severing member 17 is inside the channel 9 in front of the winding core, i.e. downstream of the new winding core and between the latter and the log L that is about to be unloaded from the winding cradle 1, 3, 5.

In this embodiment once again the core is prevented from colliding with the severing member 17 and moreover the fold-back of web material that is folded inside the log is very short, due to the fact that the line along which severing of the web material takes place is close to the new core A being inserted. Furthermore, in this case the angular position in which reversal of the alternate movement (of rotation in the example illustrated) of the severing member 17 takes place can also be programmed and modified. This allows the machine to be adjusted to compensate the wear of the pads 17A of the severing member 17, gradually moving back the point in which movement is reversed.

In other embodiments, not shown, the alternate movement of the severing member 17 is a linear movement, for example controlled through a rotary motor and a drive with threaded rod and nut, or by a linear motor.

Figure 3:
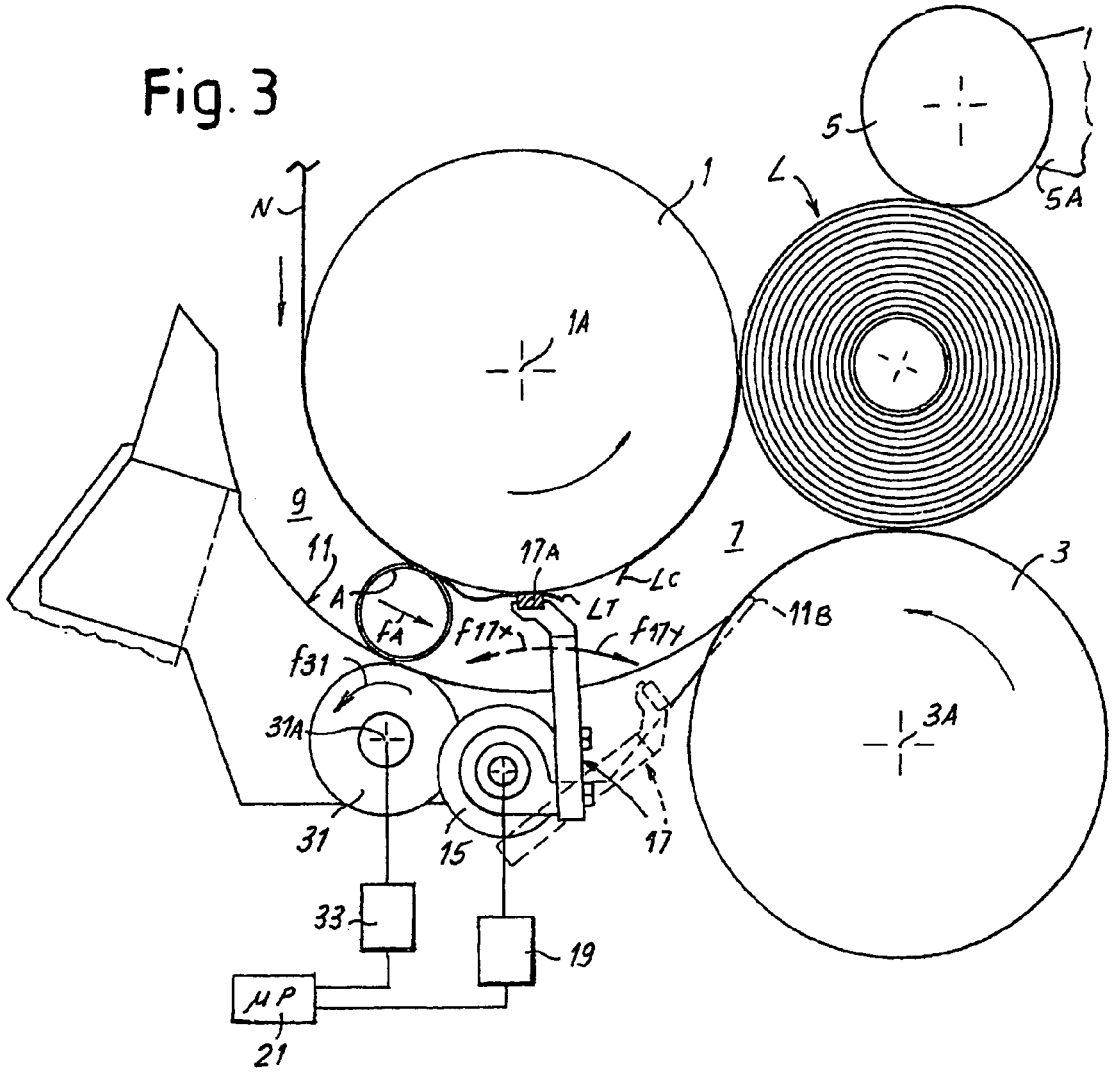
FIG. 3 shows a schematic side view of a rewinding machine in a third embodiment of the invention.

A further improved embodiment of the rewinding machine illustrated in FIGS. 2A, 2B, 2C is shown in FIG. 3. The same numbers indicate the same or equivalent parts to those of the previous embodiment.

In the embodiment shown in FIG. 3 a rotating member 31, for example constituted by disks or rollers fitted on a common shaft 31A positioned below the support surface 11 of the winding cores A, is positioned along the feed channel of the tubular cores A. The various disks forming the rotating member 31 project slightly from the support surface 11 of the tubular winding cores A.

When the severing member 17 is in the position illustrated in FIG. 3, coincident with the position illustrated in the preceding FIG. 2B, the tubular winding core A is positioned in contact superiorly with the web material guided around the winding roller 1 and inferiorly with the rotating member 31. This latter rotates in the direction indicated by the arrow f31 under the control of a motor 33 controlled by the control unit 21. The rotation speed of the winding roller 1 and the rotation speed of the rotating member 31 are controlled in such a manner that the winding core A slows or even stops its advance along the channel 9 at the moment in which the severing member 17, which has entered the channel 9, acts on the web material N pinching it and advancing in counter-clockwise direction (arrow f17*x*) in FIG. 3. The temporary stopping or slowing of advance of the core A inside the channel 9 prevents the core A and the severing member 17 from colliding when this latter acts on the web material N to cause severing thereof. Subsequently, rotation of the severing member 17 is reversed (arrow f17*y*) and the winding core A can continue to advance by rolling along the channel 9. For this purpose, the rotating member 31 is slowed or even stopped so that core starts to move forward again or in any case accelerates its advancing movement. It must be borne in mind, in this regard, that the center of the winding core A is fed at a speed (fA) equal to half of the vector sum of the speeds of the diametrically opposite points of contact of the core A with the support surface 11 or with the rotating member 31 on one side and with the web material N guided around the winding roller 1 on the opposite side.

In the embodiment of FIG. 3 it is possible to reduce the accelerations of the severing member 17 due to the possibility of slowing down, in a controlled manner, the advancement of the core A along the channel 9. Alternatively, higher production speeds and/or greater operating reliability and certainty of the machine can be achieved. The rotating member 31 can be used both in the case of a severing member 17 provided with a movement without reversal of the direction of feed (FIGS. 1A-1C), and in the case of a severing member 17 that reverses its movement (FIGS. 2A-2C) after having severed the web material.

Figure 4C:
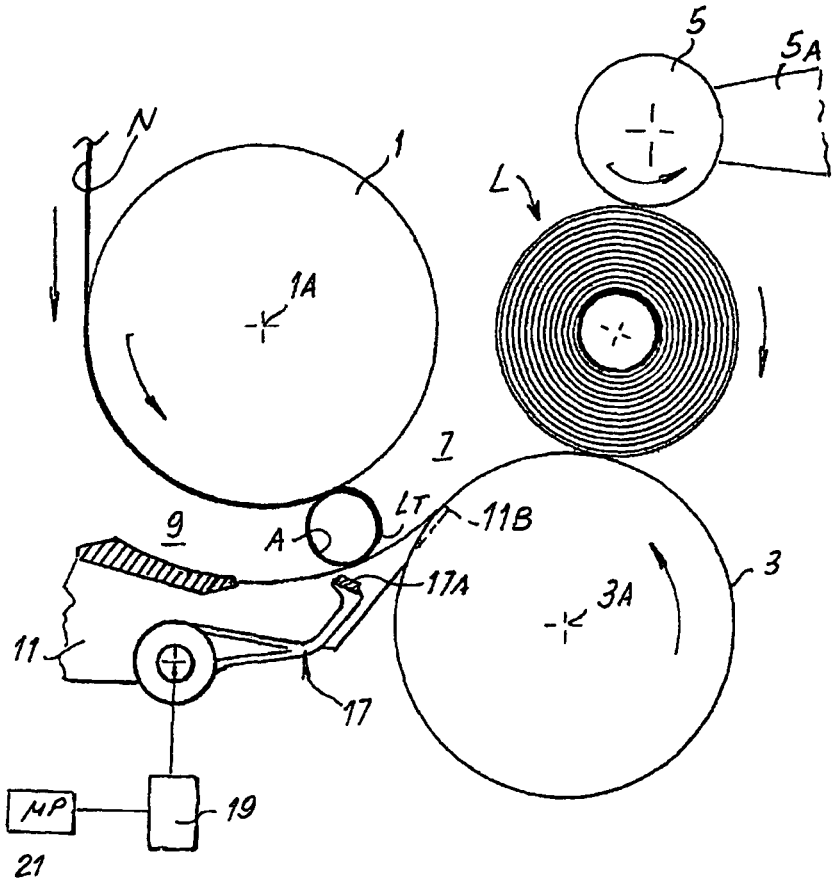

FIGS. 4A-4C show an operating sequence similar to that of FIGS. 2A-2C, with a different structural embodiment of the severing member 17. The same numbers indicate the same or equivalent parts to those of the previous examples of embodiment.

It is understood that the drawing shows just one example, provided merely as a practical demonstration of the invention, which can vary in its forms and arrangements, without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A rewinding machine for winding a web material around a tubular core, comprising:

a first winding roller, around which the web material is guided, which at least partly defines a winding cradle;

a winding cores support surface, arranged to receive a winding core and to convey the winding core toward said winding cradle, said support surface and the first winding roller defining therebetween a feed channel for winding cores;

a severing member, which is adapted to be movably inserted into said feed channel to interact with the web material to thereby cause severing of the web material, wherein speed of the severing member is modified when said severing member is positioned inside said channel, and wherein the speed of said severing member is controlled to be accelerated after causing said severing of the web.

2. The rewinding machine as claimed in claim 1, wherein said severing member is controlled by a motor.

3. The rewinding machine as claimed in claim 2, wherein said severing member is provided with a rotational movement around an axis externally present in relation to said channel.

4. The rewinding machine as claimed in claim 3, wherein said motor controls movement of said severing member to provide insertion into and advancement in said channel of the severing member in a first direction of feed and reversal of the first direction of feed of the severing member after severing of the web material.

5. The rewinding machine as claimed in claim 2, wherein said motor controls movement of said severing member to provide insertion and advancement in said channel of the severing member in a direction of advancement opposite with respect to a direction of feed of said web material and of said cores along said channel and subsequent reversal of the movement of said severing member to cause the severing member to move away from an insertion end of the channel.

6. The rewinding machine as claimed in claim 5, wherein said reversal of the movement of said severing member is performed after severing of the web material in a position between a log in said winding cradle and said severing member.

7. The rewinding machine as claimed in claim 2, wherein said severing member is rotationally mounted and adapted to enter said channel, interact with said web material in said channel and exit from said channel without reversal of a direction of movement inside said channel; and wherein said motor controls movement of the severing member to provide insertion thereof into said channel, interaction with said web material and exit from said channel at a variable speed without reversal of a direction of rotation of the severing member.

8. The rewinding machine as claimed in claim 7, wherein said severing member is adapted to interact with said web material at a speed lower than a feed speed of the web material causing severing of the web material at an intermediate point in said web material between said severing member and a log being formed in said winding cradle, and subsequently said severing member is adapted to accelerate without a reversal of movement, to reduce time in which the severing member is present in said channel after severing of the web material.

9. The rewinding machine as claimed in claim 8, wherein said severing member is further adapted to interact with said web material and cause severing thereof while moving at a speed which is no greater than 70% of the feed speed of the web material.

10. The rewinding machine as claimed in claim 1, wherein said severing member is provided with a rotational movement around an axis externally present in relation to said channel.

11. The rewinding machine as claimed in claim 10, wherein said motor controls movement of said severing member to provide insertion into and advancement in said channel of the severing member in a first direction of feed and reversal of the first direction of feed of the severing member after severing of the web material.

12. The rewinding machine as claimed in claim 10, wherein said motor controls movement of said severing member to provide insertion into and advancement in said channel of the severing member in a direction of advancement opposite with respect to a direction of feed of said web material and of said cores along said channel and subsequent reversal of the movement of said severing member to cause the severing member to move away from an insertion end of the channel.

13. The rewinding machine as claimed in claim 12, wherein said reversal of the movement of said severing member is performed after severing of the web material in a position between a log in said winding cradle and said severing member.

14. The rewinding machine as claimed in claim 1, wherein the severing member is adapted to enter said channel, interact with said web material in said channel and exit from said channel without reversal of a direction of movement inside said channel.

15. The rewinding machine as claimed in claim 1, further comprising a control member to control feed speed of the winding core in said channel.

16. The rewinding machine as claimed in claim 15, wherein said control member comprises a rotating member arranged in a position along said channel, opposite said first winding roller and at a distance therefrom so as to allow passage of the winding core between the first winding roller and said rotating member; the rotating member being positioned, with respect to a direction of feed of the winding core in said channel, upstream of an area of interaction between the severing member and the web material; the rotating member being controlled by an actuator to control feed movement of the winding core along said channel.

17. The rewinding machine as claimed in claim 1, further comprising a second winding roller, wherein the first winding roller together with the second winding roller define a nip through which said web material and the winding cores pass, said nip being positioned downstream of said channel with respect to a direction of feed of the web material.

18. The rewinding machine as claimed in claim 1, wherein said severing member is constructed and arranged to pinch the web material against the first winding roller.

19. A method for winding a web material around a winding core in a rewinding machine, comprising steps of:

feeding said web material at a feed speed around a first winding roller which at least partly defines a winding cradle;

inserting a winding core adjacent to said first winding roller in a channel between said first winding roller and a winding cores support surface;

interacting a severing member with said web material along said channel by moving said severing member into contact with said web material at a speed lower than the feed speed of the web material, causing severing of the web material at a point in the web material located between a log present in said winding cradle and said severing member;

after severing of the web material, accelerating movement of said severing member and making the severing member exit said channel.

20. The method as claimed in claim 19, wherein said severing member is controlled by a motor.

21. The method as claimed in claim 20, wherein said severing member is provided with a rotational movement around a rotation axis externally present in relation to said channel.

22. The method as claimed in claim 20, wherein said severing member is inserted into said channel and removed therefrom with a reciprocating movement.

23. The method as claimed in claim 20, wherein said severing member is inserted into said channel with a movement in a direction opposite a direction of feed of the web material and of the cores in said channel, is pressed against the web material causing severing of the web material at a point in the web material positioned between the severing member and a log being formed in the winding cradle, and subsequently reversing movement of the severing member causing the severing member to exit the channel.

24. The method as claimed in claim 20, wherein said severing member is inserted into said channel, pressed against said web material pinching the web material between said severing member and said first winding roller, and removing the severing member from said channel without reversal of a direction of feed of the severing member.

25. The method as claimed in claim 19, wherein said severing member is provided with a rotational movement around a rotation axis externally present in relation to said channel.

26. The method as claimed in claim 25, wherein said severing member is inserted into said channel and removed therefrom with a reciprocating movement.

27. The method as claimed in claim 25, wherein said severing member is inserted into said channel with a movement in a direction opposite a direction of feed of the web material and of the cores in said channel, is pressed against the web material causing severing of the web material at a point in the web material positioned between the severing member and a log being formed in the winding cradle, and subsequently reversing movement of the severing member causing the severing member to exit the channel.

28. The method as claimed in claim 25, wherein said severing member is inserted into said channel, pressed against said web material pinching the web material between said severing member and said first winding roller, and removing the severing member from said channel without reversal of a direction of feed of the severing member.

29. The method as claimed in claim 19, wherein said severing member is inserted into said channel and removed therefrom with a reciprocating movement.

30. The method as claimed in claim 19, wherein said severing member is inserted into said channel with a movement in a direction opposite a direction of feed of the web material and of the cores in said channel, is pressed against the web material causing severing of the web material at a point in the web material positioned between the severing member and a log being formed in the winding cradle, and subsequently reversing movement of the severing member causing the severing member to exit the channel.

31. The method as claimed in claim 19, wherein said severing member is inserted into said channel, pressed against said web material pinching the web material between said severing member and said first winding roller, and removing the severing member from said channel without reversal of a direction of feed of the severing member.

32. The method as claimed in claim 31, wherein said severing member is advanced in said channel in contact with the web material at a speed concordant with but lower than a feed speed of the web material until severing of the web material downstream of a point at which the severing member contacted the web material and subsequently accelerating speed of the severing member to move the severing member away from the winding core inserted in said channel.

33. The method as claimed in claim 32, wherein said severing member is fed in contact with the web material at a speed no greater than 70% of the feed speed of the web material.

34. The method as claimed in claim 19, further comprising controlling movement of said winding core in said channel by interaction of the winding core and a speed control member positioned along said channel.

35. The method as claimed in claim 19, wherein said winding core is inserted in said channel and brought into contact with the web material guided around said first winding roller, and wherein a rotating member is arranged along said channel, said rotating member being made to move in a direction so as to cause, due to contact with said winding core, temporary slowing of advancement of the winding core along said channel.

36. A rewinding machine for winding a web material around a tubular core, comprising:

a first winding roller, around which the web material is guided, which at least partly defines a winding cradle;

a winding cores support surface, arranged to receive a winding core and to convey the winding core toward said winding cradle, said support surface and the first winding roller defining therebetween a feed channel for winding cores;

a severing member which is adapted to be movably inserted into said feed channel to interact with the web material to cause severing of the web material, wherein speed of the severing member is modified when said severing member is positioned inside said channel, wherein the speed of said severing member is controlled to be accelerated after causing said severing of the web, wherein said severing member is controlled by a motor, and wherein said motor controls movement of said severing member to provide insertion into and advancement in said channel of the severing member in a first direction of feed and reversal of the first direction of feed of the severing member after severing of the web material.

37. A method for winding a web material around a winding core in a rewinding machine, comprising steps of:

feeding said web material at a feed speed around a first winding roller which at least partly defines a winding cradle;

inserting a winding core adjacent to said first winding roller in a channel between said first winding roller and a winding cores support surface;

interacting a severing member with said web material along said channel by moving said severing member into contact with said web material at a speed lower than the feed speed of the web material, causing severing of the web material at a point in the web material located between a log present in said winding cradle and said severing member;

after severing of the web material, accelerating movement of said severing member and making the severing member exit said channel;

wherein said severing member is inserted into said channel with a movement in a direction opposite a direction of feed of the web material and of the cores in said channel, is pressed against the web material causing severing of the web material at a point in the web material positioned between the severing member and a log being formed in the winding cradle, and subsequently reversing movement of the severing member causing the severing member to exit the channel.

* * * * *